US006616085B2

(12) United States Patent
Fuchs et al.

(10) Patent No.: US 6,616,085 B2
(45) Date of Patent: Sep. 9, 2003

(54) WINDER SPLICING NIP GUARD

(75) Inventors: Lawrence J. Fuchs, Denmark, WI (US); Michael J. Daul, Appleton, WI (US); David R. Mulry, Combined Locks, WI (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/076,030

(22) Filed: Feb. 12, 2002

(65) Prior Publication Data

US 2003/0150952 A1 Aug. 14, 2003

(51) Int. Cl.[7] ..... B65H 63/00
(52) U.S. Cl. ..... 242/534; 242/548; 242/913
(58) Field of Search ..... 242/539, 534, 242/542, 542.1, 542.2, 542.4, 548, 913

(56) References Cited

U.S. PATENT DOCUMENTS 1,575,088 A * 3/1926 Bartlett ..... 74/613
3,104,845 A * 9/1963 Patterson, Jr. et al. ... 242/541.6
3,342,433 A * 9/1967 Klaczkiewicz ..... 242/542
3,346,209 A 10/1967 Cronin
3,918,654 A 11/1975 Okubo et al.
4,345,722 A 8/1982 Kuhn
4,422,588 A 12/1983 Norwisch
5,492,287 A 2/1996 Raudaskoski et al.
5,924,647 A 7/1999 Dorfel

* cited by examiner

*Primary Examiner*—Kathy Matecki
*Assistant Examiner*—Sang Kim
(74) *Attorney, Agent, or Firm*—Stiennon & Stiennon

(57) ABSTRACT

A guard is mounted for rotation about the downstream drum of a winder having two spaced apart winder drums which support a paper roll. The guard has a D-shaped leading-edge which approaches the paper roll. The leading-edge is articulated so that if an operator's hand becomes wedged between the leading-edge and the paper roll, articulation on the leading-edge closes a switch which brings the winder to a stop. A hydraulic actuator extends between a lowermost radial edge of each sector shaped extension and a fixed support. Operation of the hydraulic actuator causes the guard to rotate about the axis of the downstream winder drum so as to be between an operator and the downstream side of the winder drum. The leading edge of the the guard is positioned to limit operator access to the nip formed between the paper roll and the downstream winder drum.

20 Claims, 3 Drawing Sheets

WINDER SPLICING NIP GUARD

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to winders in general and to guards to increase the safety of threading or splicing a broken web in particular.

Papermaking is a continuous process which can be stopped and started only at considerable expense in time and material which must be recycled. Paper on the other hand is used in rolls often referred to as offsets. As paper is manufactured, it is wound onto a single large roll, sometimes referred to as a jumbo roll. The jumbo roll extends the full width of the papermaking machine, which can be 300 or 400 inches, and can be six to ten or more feet in diameter. These larger rolls are broken down into the smaller rolls used by the printing industry, on a machine referred to as a winder. Large moving rolls of any type have certain inherent dangers, particularly where one roll rides against another to form a nip. An operator's hand can be caught in such a nip drawing the operator into the nip with highly undesirable consequences.

To avoid such hazards, the winding of paper into offset rolls is typically effected automatically or semiautomatically by machinery which usually does not require the operator's presence immediately adjacent to the moving rolls which form the winder. However, if a paper break occurs during the winding process, an operator is necessary to remedy the break. Repairing an offset reel of paper involves cutting or slabbing off the outer layers of loosely wound paper, taping a new start to a clean tail formed by the slabbing off process, and restarting the winding process. During the repair of a paper break the operator is working on the paper roll itself and is thus in a position near where the forming paper roll and a winder drum of the winder form a nip. The nip is rendered more hazardous by the fact that the winder drum has an aggressive high friction surface to better engage and cause the paper roll to rotate. This aggressive surface can make it difficult to withdraw an extremity once it enters the nip formed between the winder drum and the offset roll.

What is needed is a system which creates a physical barrier between the nip and the operator to provide an additional margin of safety.

SUMMARY OF THE INVENTION

The winder of this invention has two spaced apart winder drums which support a paper roll. A paper web from a parent roll partially wraps the upstream winder drum and then wraps a roll core to form the paper roll. Both winder drums are driven to cause the paper roll to rotate. The downstream winder drum rotates about a drum axis on drum bearings. A guard is mounted for rotation about the downstream winder drum axis. The guard has two radially extending sector shaped flanges which are spaced inwardly of the drum bearings and to which is mounted a substantially cylindrical shell which forms the body of the guard. Each radially extending flange has a bearing ring, and extends beyond the cylindrical shell. The cylindrical shell has a D-shaped leading edge which approaches the paper roll, the leading edge is articulated so that if the operator's hand becomes wedged between the leading edge and the paper roll articulation on the leading-edge closes the switch which brings the winder to a stop. A hydraulic actuator extends between a lowermost radial edge of each sector shaped extension, and a fixed support. Operation of the hydraulic actuator causes the guard to rotate about the axis of the downstream winder drum so as to be between an operator and the downstream side of the winder drum. The leading edge of the the guard is positioned to limit operator access to the nip formed between the paper roll and the downstream winder drum.

Spring loaded disk brakes are positioned to brake upon lower portions of the sector shaped extensions. The brakes can be opened by a hydraulic mechanism but are failsafe in the spring loaded braking configuration. Movement of the guard is controlled from the operator's control booth, or from dual switches positioned on either side of the winder and spaced sufficiently far from the winder so that the operator cannot come in contact with the winder while controlling the position of the guard. A light curtain is positioned so that the operator's hands passes through the light curtain to contact the paper roll. So long as the operator's hands are passing through the light curtain movement of the guard is inhibited. A long linear switch is positioned on the long leg of the a sector shaped member adjacent the blunt leading edge. Actuation of the linear switch causes all motion of the downstream winder drum and the paper roll to stop. The guard's leading edge is positioned approximately 12 to 14 inches from the nip formed between the driven downstream winder drum and the paper roll, after the paper roll reaches a selected diameter.

It is a feature of the present invention to provide a winder with a movable guard to increase operator safety while performing a splice.

It is a further feature of the present invention to provide a winder with a movable guard which prevents the operator from coming in contact with a nip formed between the downstream winder drum and the paper roll.

It is another feature of the present invention to provide a winder with a movable guard which supports a work area for preparing a paper splice.

It is a yet further feature of the present invention to provide a winder with a movable guard capable of incorporating a core loader.

It is a still further feature of the present invention to provide a winder with a movable guard which can support a bridge for the removal of a wound paper roll.

Further objects, features and advantages of the invention will be apparent from the following detailed description when taken in conjunction with the accompanying drawings.

DESCRIPTION OF THE PREFERRED EMBODIMENTS

Figure 1:
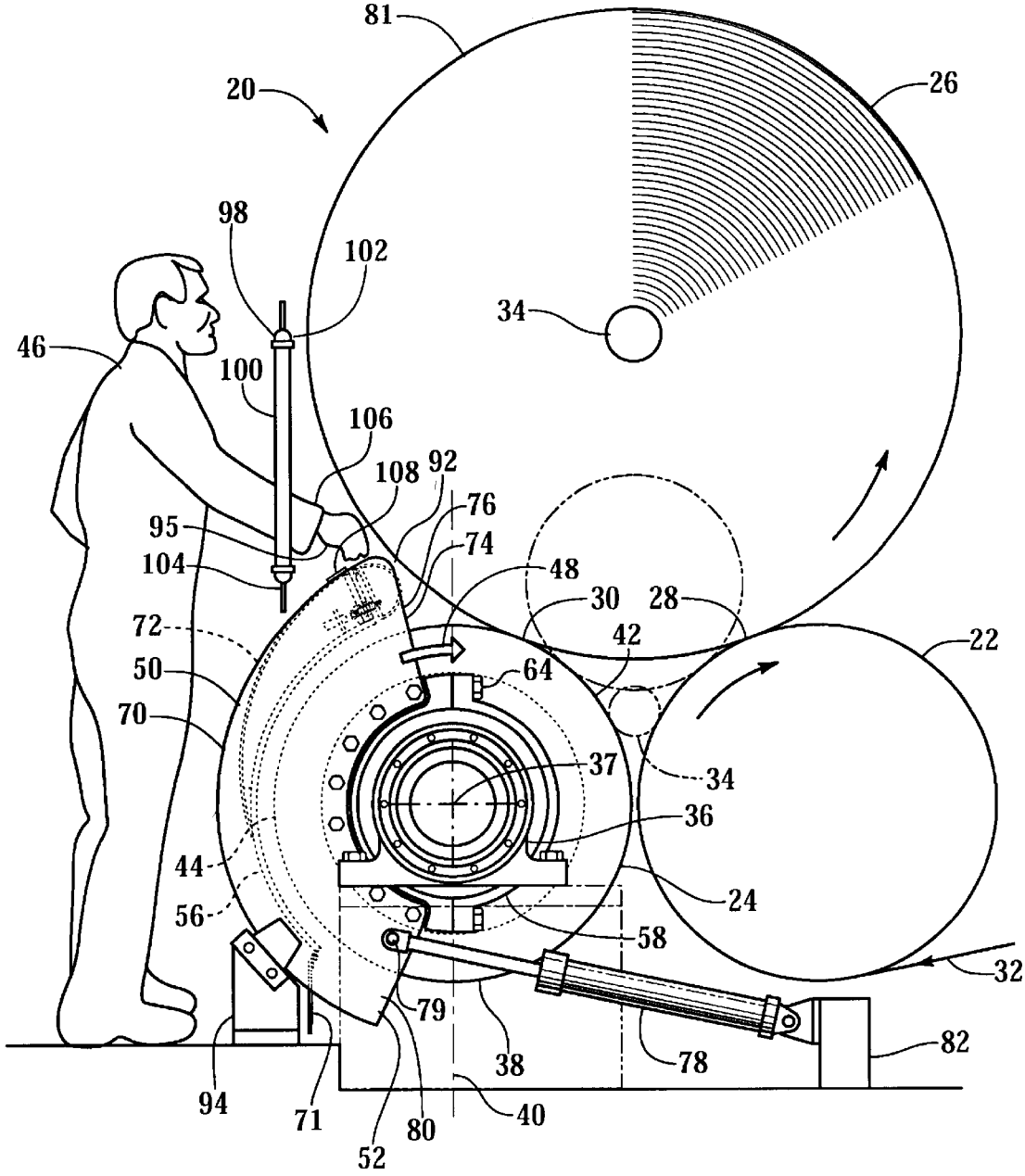
FIG. 1 is a side elevational view of the winder and winder guard of this invention.

Referring more particularly to FIGS. 1–5, wherein like numbers refer to similar parts, a winder 20 of the double drum type is shown in FIG. 1. The winder has a first upstream winder drum 22, and a second downstream winder drum 24 which support a paper roll 26. The paper roll 26 forms a first nip 28 with the upstream winder drum 22 and a second downstream nip 30 with the downstream winder drum 24. A paper web 32 from a jumbo roll or the like (not shown) wraps around the upstream winder drum 22 and onto a roll core 34 about which is formed the paper roll 26. The downstream winder drum 24 is mounted between drum bearings 36 and is driven through a drive, not shown, about a drum axis 37. The winder drum 24 has an aggressive surface 38 in order to grip and turn the paper roll 26. The winder drum 24 may be divided by an imaginary vertical plane 40 passing through the drum axis 37 to define an upstream sector 42 encompassing the upstream half of the drum 24, and a downstream sector 44 encompassing the downstream half of the drum 24.

When it is necessary to gain access to the forming paper roll 26 for the purpose of repairing a paper break an operator 46 stands downstream of the downstream sector 44 of the downstream winder drum 24. As indicated by the arrow 48, the downstream winder drum 24 rotates towards the nip 30 and, because of its aggressive surface 38, has the potential of drawing the operator's hand 95 into the nip 30. In order to prevent the operator's hand 95 from being drawn into the nip 30, the winder 20 employees a guard 50.

Figures 5, 6:
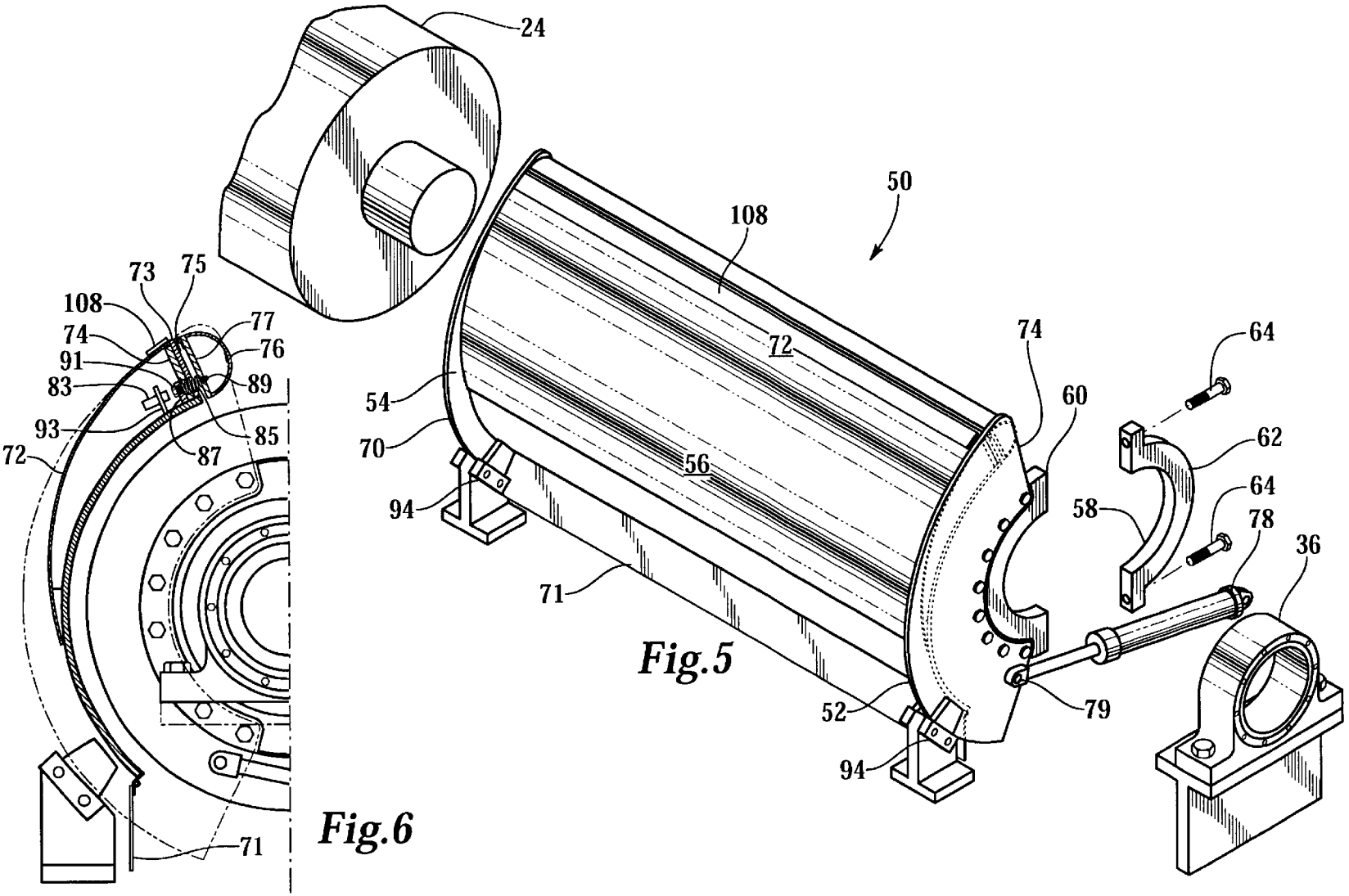
FIG. 5 is an exploded isometric view of the winder guard and downstream winder drum of FIG. 1.
FIG. 6 is a enlarge partial side elevational view of the winder and winder guard of FIG. 1 with the flange extension shown in phantom.

As best shown in FIG. 5, the guard 50 comprises a first radially extending sector shaped flange 52 and a second radially extending sector shaped flange 54 which are connected by a substantially semicylindrical shell 56 which blocks operator access to the surface 38 of the downstream winder drum 24. The first sector shaped flange 52 is mounted to a split ring bearing 58 comprised of a guard side 60 and a mounting side 62 which are joined by bolts 64. The radially extending sector shaped flange 52 is bolted to the guard side 60 of the split ring bearing 58. The second radially extending sector shaped flange 54 similarity is mounted to a split ring bearing (not shown).

The cylindrical shell 56 extends around approximately one hundred twenty-six degrees of the circumference of the downstream winder drum 24, the shell 56 is not perfectly cylindrical but spirals inwardly towards the axis 37 about one inch in the lowermost fifty degrees of the semicylindrical shell. The semicylindrical shell 56 is spaced inwardly of the outer edge 70 of the flanges 52, 54 about 3½ inches, and spaced two to three inches outwardly from the surface 38 of the downstream winder drum 24. A hinged guard extension 71 constructed of heavy rubber is attached to the trailing edge of the shell 56.

A second outer shell 72 extends from the radially outwardly extending plate 74 and is mounted between and perpendicular to the flanges 52, 54. The outer shell 72 wraps approximately eighty degrees of the drum circumference gradually spiraling inwardly to join the shell 56 as shown in FIG. 1 and FIG. 6. As shown in FIG. 6, a blunt leading edge 76 of about four inches in radial extent, is hingedly mounted to the upper edge 73 of the outer shell 72 by a hinge 75. The blunt leading edge 76 is semi-cylindrical in shape, and has a backplate 77 which is positioned substantially parallel to the radially outwardly extending plate 74. The blunt leading edge 76 is arranged to hinge inwardly toward the backplate 77 if the operator's hand 95 or other object gets caught in the gap 92 between the guard 50 and the surface 81 of the paper roll 26. The articulated motion of the leading edge 76 closes a switch 83 which causes the winder to come to a abrupt stop wherein the guard 50 can be retracted to release the operator's hand 95. The leading edge 76 is biased and away from the plates 74 by a spring 85 which extends between the backplate 77 through an aperture in the plates 74 to a stop 87. A bolt 89 is mounted to the backplate 77 through the aperture in the plate 74 and extends through an aperture in the stop 87. The head 91 of the bolt 89 is held against the stop by the biasing spring 85. If the leading edge 76 is caused to hinge inwardly, the bolt head 91 moves towards the switch 83. The switch 83 is mounted to a bracket 93 which is spaced from the stop 87. The switch 83 is of the magnetic field sensing type and detects the approach of the bolt head 91 and stops all the motion of the winder.

Figure 2:
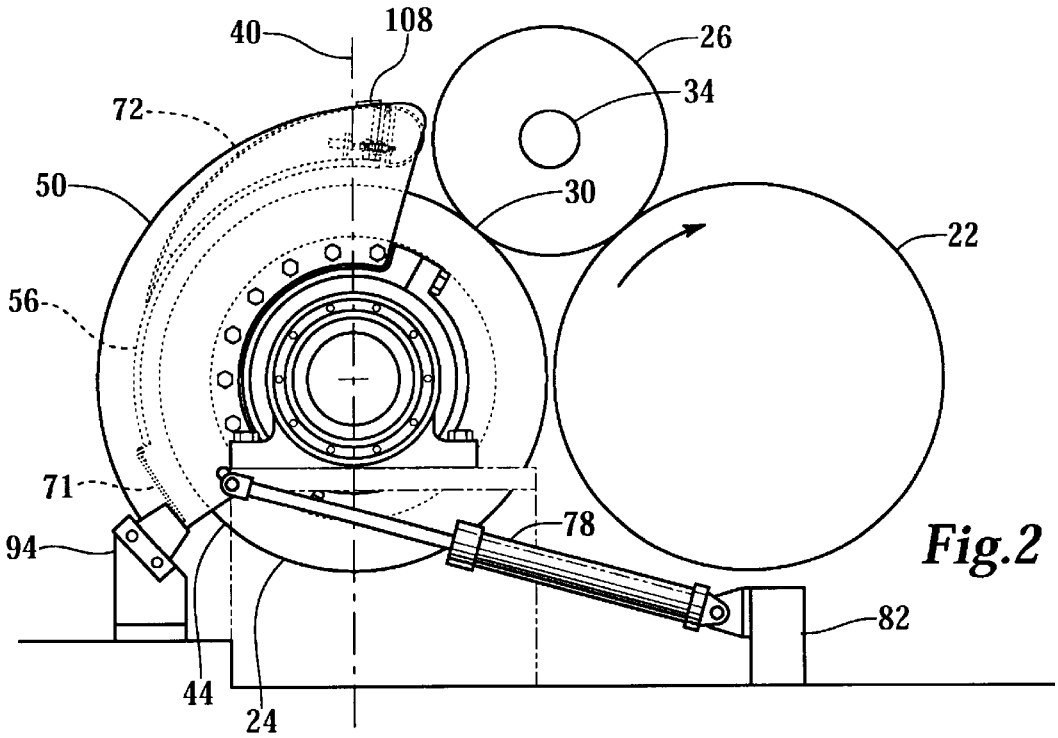
FIG. 2 is a side elevational view of the winder and winder guard of FIG. 1 with the guard in the full raised position.
Figure 3:
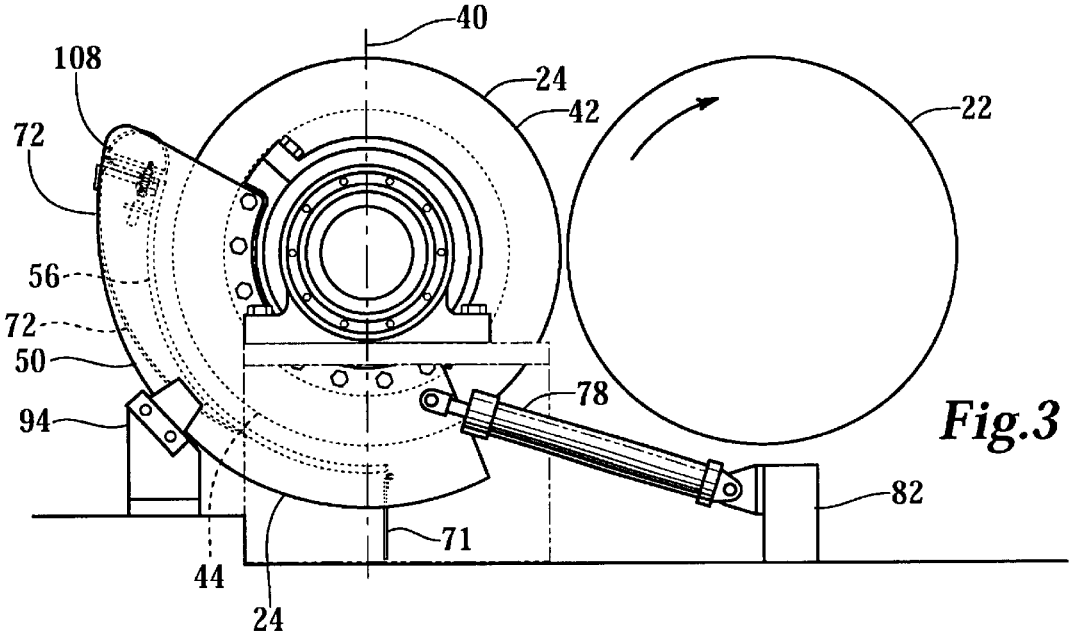
FIG. 3 is a side elevational view of the winder and winder guard of FIG. 1 with the guard in the fully lowered position.
Figure 4:
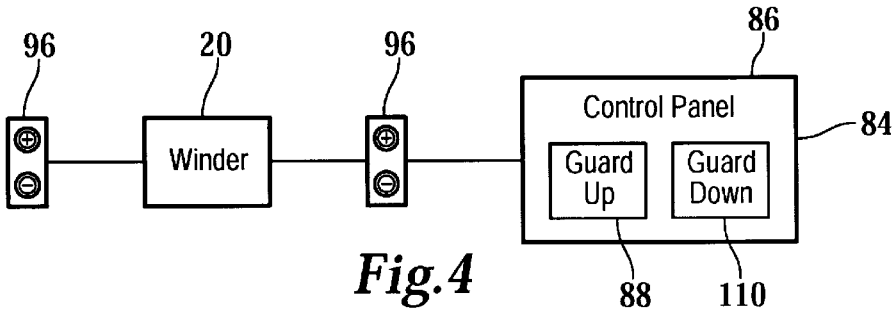
FIG. 4 is a schematic view of the winder of FIG. 1 together with associated control panels.

The guard 50 is rotated about the drum axis 37 by hydraulic actuators 78 which extend from attachment points 79 on the trailing edges 80 of the flanges 52, 54 to two fixed supports 82 positioned upstream of the winder drum 24 and below the attachment points 79. The hydraulic actuators 78 move the guard over a travel range of seventy-five degrees as shown in FIGS. 1, 2, and 3, while at all times the guard 50 substantially occupies the downstream sector 44 which presents the possible hazard to the operator 46. In other words more than half of the downstream sector 44 is always occupied by the guard 50, and at the same time this means at least 90 degrees of the guard's circumferential extent always remains within the downstream sector 44.

The guard 50 is used when a paper break occurs. While the winder 20 is operating normally, the operator 46 is positioned in front of a control panel 86 which is located a distance from the winder 20. Upon the detection of a paper break, the operator raises the guard 50 by pressing a switch 88 on the control panel 86. The blunt leading edge 76 is positioned by the hydraulic actuators 78 one to one-half inches from the paper roll 26 when an operator is present. The position of the guard 50 may be controlled by the controller 84, which may be contained within the control panel 86. The controller 84 receives input from a paper roll height measuring instrument (not shown), which allows proper positioning of the guard 50. The operator may now approach the winder 20 where the process of effecting a splice is performed. This process normally involves cutting away, or slabbing off, the outermost layers of the paper roll 26 and rotating the paper roll to remove the cutaway layers.

A splice is prepared typically by taping the free end of the web 32 to the paper roll 26. These operations require the operator to place his hands near the roll, and possibly to engage the paper roll 26. The safety of this operation is enhanced by the presence of the guard 50 which is positioned to be closely spaced from the surface 81 of the paper roll 26. The upper surface of the shell 72 is spaced radially outwardly of the surface 38 of this downstream winder drum 24 which causes the blunt leading edge 76 of the guard 50 to be distant approximately 10 to 14 inches from the nip 30 between the paper roll 26 and the downstream winder drum 24. The narrow width of the gap 92 prevents the operator from extending a hand more than about five or six inches inward in the gap 92. In addition, the guard 50 completely prevents a hand from engaging the aggressive surfaces 38 of the winder drum 24.

Motion of the guard 50 while the operator 46 is present is prevented by spring loaded brakes 94 which are similar to disc brakes and which grip the flange extensions 52, 54 as shown in FIGS. 1–3, and 5. The brakes 94 are of a type known in the art where spring force is used to apply the braking force and a hydraulic mechanism is used to release the brakes, such that the brakes fail in the engaged position.

The guard 50 can be raised and lowered from the control panel 86, and can also be controlled from switches 96 on either side of the winder 20. To prevent the guard from being moved while an operator 46 is positioned near the guard, the switches 96 are positioned sufficiently far from the winder 20 so that the person operating the switches 96 cannot come into contact with the winder. Further, the switches are wired so that the guard can be raised and lower only by the simultaneous operation of both switches 96 so that two operators are required. When the guard 50 is lowered to gain access to the drum 24, the winder is not driven. When the guard 50 is in the up position closely spaced from the paper roll 26 the winder may be jogged.

A light curtain 98, which extends the width of the paper roll 26, projects light 100 between an upper member 102 and a lower member 104 so that the operator's arm 106 passes through the light curtain 98 in order to access the paper roll 26 or the guard 50. Movement of the guard 50 is interlocked with the light curtain 98 so that the guard 50 cannot be moved when the light curtain detects the operator's arm 106. Because it may be necessary to jog, i.e. operate the winder at slow speed, while the operator is present, a tape switch 108 which is one continuous switch is positioned along the top of the guard shells 72 adjacent to the blunt leading-edge 76. The safety tape 108 is connected to the winder drives so the operation of the switch 108 by pressing or leaning against the switch stops all motion of the winder 20. The light curtain 98 and tape switch 108 are available from Tapeswitch Corporation (www.tapeswitch.com). After the splicing operation is completed the operator 46 returns to the control panel 86 and operates a switch 110 which lowers the guard 50 to the position shown in FIG. 3.

It should be understood that the guard 50 may be positioned based on the size of the roll 26, or a contact switch could be mounted on the portion of the leading edge 76 and spaced one to one-half inches outwardly from the leading edge to contact the roll and thus positioned the guard 50.

It should be understood that the hydraulic actuators 78 could be replaced by a chain drive driven by a hydraulic motor and brake system, or other comparable mechanical systems for positioning the guard 50.

It should be understood that hydraulic system used with the hydraulic actuators 78 includes design features to prevent rapid movement of the actuator due to a break in the hydraulic supply lines.

It should further be understood that the guard could incorporate a core loader, or a core loader could be rebuilt to incorporate a guard 50. The guard 50 could also function with a bridge to assist the removal of the completed paper roll 26 with or without an additional support positioned to engage the cylindrical shell 56 between the sector shaped flanges 54, 56 to increase the load bearing capabilities of the guard 50.

It is understood that the invention is not limited to the particular construction and arrangement of parts herein illustrated and described, but embraces all such modified forms thereof as come within the scope of the following claims.

We claim:

1. A winder with integrally mounted guard comprising:

a first upstream winder drum;

a second downstream winder drum, having a drum surface, the second downstream winder drum being mounted for rotation about a first axis and defining circumference and an upstream sector and a downstream sector, wherein the drum surface is driven to rotate upwardly in the downstream sector;

a paper roll forming a first nip with the first upstream winder drum and a second nip with the second downstream winder drum;

a the guard mounted about the second downstream winder drum, the guard further comprising:

a first rotatably mounted radially extending flange mounted for rotation about the first axis and substantially within the downstream sector of the second downstream winder drum, a second rotatably mounted flange mounted for rotation about the first axis and substantially within the downstream sector of the second downstream winder drum;

a shell connecting the first radially extending flange to the second radially extending flange, the shell lying radially outwardly of the second winder drum, and extending more than 90 degrees about the circumference of the winder drum;

an actuator connected to the guard to cause the shell and the guard to rotate about the first axis, wherein the range of motion of the actuator causes more than 90 degrees of the shell to remain within the downstream sector of the second winder drum, and wherein a radially extending portion of the first flange extends beyond the shell; and a brake positioned to engage the radially extending portion of the first flange.

2. The winder of claim 1 wherein the shell has a leading edge which has a radial thickness sufficient so that when spaced 1 to 1½ inches from the paper roll, a gap is defined between the leading edge and the paper roll, the gap being spaced more than 12 inches from the second nip, after the paper roll has reached a selected diameter.

3. The winder of claim 1 further comprising a switch extending across the shell so that an operator standing downstream of the guard must reach across the a tape switch to place an extremity between the guard and the paper roll, the switch operably connected to a leading edge to stop rotation of the winder when contacted by the operator.

4. The winder of claim 1 further comprising a light curtain positioned downstream of the paper roll so that an operator standing downstream of the guard can place his hands through the light curtain to gain access to the paper roll, wherein motion of the guard is inhibited when the light curtain is obstructed by the operator's hand.

5. The winder of claim 1 further comprising a trailing guard plate pivotally mounted to a lowermost trailing edge formed by the shell.

6. The winder of claim 1 wherein the brake is spring biased against the radially extending portion of the first flange, and is released by hydraulic actuator.

7. The winder of claim 1 further comprising dual electronic control switches controlling the actuator, positioned on either side in the cross machine direction and spaced so that two operators are required to move the guard.

8. The winder of claim 1 wherein the shell has a leading edge which is movable toward and away from the paper roll, and wherein the leading edge is movable in response to an object coming between the leading edge and the paper roll, a switch operably connected to the leading edge to detect motion of the leading edge.

9. A winder with integrally mounted guard comprising:

a first upstream winder drum;

a second downstream winder drum, having a drum surface, mounted for rotation about a first axis, and defining a circumference and a upstream sector and a downstream sector and the drum surface driven to rotate upwardly in the downstream sector;

a paper roll forming a first nip with the first upstream winder drum and a second nip with the second downstream winder drum;

a the guard mounted about the second downstream winder drum, the guard further comprising:

a first rotatably mounted radially extending flange mounted for rotation about the first axis and substantially within the downstream sector of the downstream winder drum;

a second rotatably mounted flange mounted for rotation about the first axis and substantially within the downstream sector of the downstream winder drum;

a shell connecting the first radially extending disk to the second radially extending disk, the shell lying radially outwardly of the second winder drum, and extending more than 90 degrees about the circumference of the winder drum;

an actuator connected to the guard to cause the shell and the guard to rotate about the first axis;

wherein the range of motion of tile actuator causes more than 90 degrees of the shell to remain within the downstream sector of the second winder drum; and wherein the shell has a leading edge which has a radial thickness sufficient so that when spaced 1 to 1½ inches from the paper roll a gap is defined between the leading edge and the paper roll the gap being spaced more than 12 inches from the second nip, after the paper roll has reached a selected diameter.

10. The winder of claim 9 further comprising a radially extending portion of the first rotatably mounted radially extending flange which extends beyond the shell; and a brake positioned to engage the radially extending portion, and a hydraulic actuator attached to a lowermost trailing edge of at least one of the first rotatable mounted radial extending flange, and the second rotatable mounted flange.

11. The winder of claim 9 further comprising a switch extending across the shell so that an operator standing downstream of the guard must reach across the switch to place an extremity between the guard and the paper roll, the tape switch operably connected to the leading edge to stop rotation of the winder.

12. The winder of claim 9 further comprising a light curtain positioned downstream of the paper roll so that an operator standing downstream of the guard can place his hands through the light curtain to gain access to the paper roll, wherein motion of the guard is inhibited when the light curtain is obstructed by the operator's hand.

13. The winder of claim 9 further comprising a trailing guard plate pivotally mounted to a lowermost trailing edge formed by the shell.

14. The winder of claim 9 further comprising duel electronic control switches controlling the actuator positioned on either side in the cross machine direction and spaced so that two operators are required to move the guard.

15. The winder of claim 9 wherein the shell has a leading edge which is movable toward and away from the paper roll, and wherein the leading edge is movable in response to an object coming between the leading edge and the paper roll, and a switch is operably connected to the leading edge to detect motion of the leading edge.

16. The winder of claim 15 further comprising a second outer shell spaced radially outwardly of the cylindrical shell, the second outer shell extending from adjacent the leading edge, in a gradually spiraling inwardly until the second outer shell joins the cylindrical shell.

17. A winder with integrally mounted guard comprising:

a first upstream winder drum;

a second downstream winder drum mounted for rotation about a first axis and having a drum surface, the second downstream winder drum defining a circumference, an upstream sector and a downstream sector, and wherein the drum surface is driven to rotate upwardly in the downstream sector and downwardly in the upstream sector;

a paper roll forming a first nip with the first upstream winder drum and a second nip with the second downstream winder drum;

a the guard mounted about the second downstream winder drum, the guard further comprising:

a first rotatably mounted radially extending flange mounted for rotation about the first axis and substantially within the downstream sector of the downstream winder drum;

a second rotatably mounted flange mounted for rotation about the first axis and substantially within the downstream sector of the downstream winder drum;

a shell positioned in the downstream sector and mounted for rotation about the first axis, the shell lying radially outwardly of the second winder drum, and extending more than 90 degrees about the circumference of the winder drum;

an actuator connected to the guard to cause the shell and the guard to rotate about the first axis, wherein the range of motion of the actuator causes at least 90 degrees of the shell to remain within the downstream sector of the second winder drum, and wherein the shell has a leading edge which is movable toward and away from the paper roll, and wherein the leading edge is movable in response to an object coming between the leading edge and the paper roll; and a switch operably connected to the leading edge to detect motion of the leading edge.

18. The winder of claim 17 further comprising a said witch extending across the shell so that an operator standing downstream of the guard must reach across the switch to place an extremity between the guard and the paper roll, the tape switch operably connected to the leading edge to stop rotation of the winder when contacted by the operator.

19. The winder of claim 17 further comprising a light curtain positioned downstream of the paper roll so that an operator standing downstream of the guard can place his hands through the light curtain to gain access to the paper roll, wherein motion of the guard is inhibited when the light curtain is obstructed.

20. The winder of claim 17 wherein said switch is a tape switch which extends across the shell so that an operator standing downstream of the guard must reach across the tape switch to place an extremity between the guard and the paper roll, the tape switch operably connected to the leading edge to stop rotation of the winder.

* * * * *

UNITED STATES PATENT AND TRADEMARK OFFICE

CERTIFICATE OF CORRECTION

PATENT NO. : 6,616,085 B2 
DATED : September 9, 2003
INVENTOR(S) : Larry Fuchs et al.

It is certified that error appears in the above-identified patent and that said Letters Patent is hereby corrected as shown below:

Column 6,
Line 10, “a the” should be -- the --.
Line 42, “the a” should be -- a --.

Column 7,
Line 11, “a the” should be -- the --.
Lines 49-50, “the tape switch” should be -- the switch --.

Column 8,
Line 21, “a the” should be -- the --.
Lines 48-49, “a said witch” should be -- said switch --.
Lines 51-52, “the tape switch” should be -- the switch --.

Signed and Sealed this

Fourth Day of November, 2003

JAMES E. ROGAN
*Director of the United States Patent and Trademark Office*